US008668270B2

(12) United States Patent
Ciepiela

(10) Patent No.: US 8,668,270 B2
(45) Date of Patent: Mar. 11, 2014

(54) REMOVABLE HEAD AND NECK SUPPORT FOR RECLINING SALON CHAIR

(76) Inventor: Marzena Ciepiela, Elmwood Park, IL (US)

( * ) Notice: Subject to any disclaimer, the term of this patent is extended or adjusted under 35 U.S.C. 154(b) by 185 days.

(21) Appl. No.: 13/334,109

(22) Filed: Dec. 22, 2011

(65) Prior Publication Data

US 2013/0161997 A1 Jun. 27, 2013

(51) Int. Cl.
*A47C 7/38* (2006.01)
*A45D 44/10* (2006.01)

(52) U.S. Cl.
CPC ..... *A47C 7/383* (2013.01); *A45D 44/10* (2013.01)
USPC ..... 297/397; 297/399

(58) Field of Classification Search
CPC ..... A47C 7/383; A47C 7/38; A45D 44/02; A45D 44/10
USPC ..... 297/394, 397, 399, 400, 401
See application file for complete search history.

(56) References Cited

U.S. PATENT DOCUMENTS

| | | | | |
|---|---|---|---|---|
| 490,865 | A * | 1/1893 | Dreisbach | 297/401 |
| 2,566,757 | A * | 9/1951 | Alexander | 297/401 |
| 2,606,600 | A * | 8/1952 | Challis | 297/401 |
| D247,312 | S | 2/1978 | Zeiss | |
| D288,727 | S | 3/1987 | Mandeville | |
| D307,526 | S | 5/1990 | McIntyre | |
| D311,109 | S | 10/1990 | Geschwender | |
| D333,884 | S | 3/1993 | Colett | |
| 5,205,611 | A | 4/1993 | Stephens | |
| D335,419 | S | 5/1993 | Michalek | |
| 5,273,342 | A * | 12/1993 | Pratt | 297/397 |
| D376,034 | S | 11/1996 | Willis | |
| D395,781 | S | 7/1998 | Golder | |
| 5,799,344 | A | 9/1998 | Najar | |
| 5,829,832 | A * | 11/1998 | Molee et al. | 297/397 |
| 5,924,145 | A | 7/1999 | Najar | |

(Continued)

FOREIGN PATENT DOCUMENTS

| | | | |
|---|---|---|---|
| CN | 201861285 | U | 7/2011 |
| DE | 10 2009 021 267 | A1 | 11/2010 |

(Continued)

OTHER PUBLICATIONS http://www.alibaba.com/product-gs/499843058/salon_chair_headrest.html.

(Continued)

*Primary Examiner* — Sarah B McPartlin
(74) *Attorney, Agent, or Firm* — Law Office of Lesley A. Wallerstein, LLC

(57) ABSTRACT

An improved head and neck support couples to an upper back edge of a chair. In a preferred embodiment, the support couples to an upper back edge of a reclining salon chair. The improved support comprises a rigid inner clamping means, an inner filling of compressible memory material, all enclosed by an outer covering with a sufficiently high coefficient of friction to grip the front and the back of an upper back of the chair under the weight of a user's head as the user reclines in the chair. The composite filled support further comprises an upper portion, and a lower portion, said lower portion defining a groove along the length of the support, into which an upper back edge of a reclining salon chair may be wedged by friction fit.

20 Claims, 5 Drawing Sheets

(56) References Cited

U.S. PATENT DOCUMENTS

| | | | | |
|---|---|---|---|---|
| 5,934,754 | A * | 8/1999 | Raffa | 297/392 |
| D418,711 | S | 1/2000 | Mettler | |
| 6,115,856 | A | 9/2000 | Najar | |
| 6,550,078 | B1 | 4/2003 | Brown | |
| 6,610,382 | B1 * | 8/2003 | Kobe et al. | 428/119 |
| D593,352 | S | 6/2009 | Sherwin | |
| 7,543,887 | B2 * | 6/2009 | Tatlock | 297/217.3 |
| 7,874,024 | B1 | 1/2011 | Singh | |
| 2007/0136941 | A1 | 6/2007 | Giardina | |

FOREIGN PATENT DOCUMENTS

| | | | |
|---|---|---|---|
| FR | 2 929 186 | B1 | 11/2010 |
| FR | 2 947 777 | B1 | 7/2011 |
| FR | 2 927 853 | B1 | 8/2011 |

OTHER PUBLICATIONS http://www.instructables.com/id/Temporary-Wheelchair-Headrest-Attachment/.

http://www.amazon.com/Headrest-Herman-Miller-Aeron-Chair/dp/B003DDA0PG/ref=cm_cr_pr_product_top.

http://www.alibaba.com/showroom/salon-chair-headrest.html.

http://www.nextag.com/barber-chair-headrest/shop-html.

* cited by examiner

REMOVABLE HEAD AND NECK SUPPORT FOR RECLINING SALON CHAIR

CROSS-REFERENCE TO RELATED APPLICATION (not applicable)

STATEMENT REGARDING FEDERALLY SPONSORED RESEARCH OR DEVELOPMENT (not applicable)

NAMES OF PARTIES TO A JOINT RESEARCH AGREEMENT (not applicable)

REFERENCE TO SEQUENCE LISTING, A TABLE OR A COMPUTER PROGRAM LISTING COMPACT DISC APPENDIX (not applicable)

FIELD OF THE INVENTION

This invention relates to neck and head supports, particularly neck and head supports which conform to the cervical spine and neck muscles, and which can be removably attached to a chair, preferably a reclining salon chair.

BACKGROUND OF THE INVENTION

Millions of people each year seek out the services of a professional hair salon to style or chemically treat their hair. The salon typically has a separate sink station, where attendants can apply shampoo or conditioner, massage the scalp, apply chemicals and then rinse customers' hair. At the sink station, it is necessary to have the customer's head at the upper level of the sink. Customarily, the customer sits in a chair which faces away from the sink and which reclines to bring the customer's head over the edge of the sink basin and oriented toward the water supply.

While this arrangement optimizes the distance between the customer's head and the water supply, and minimizes liquid spillage onto the floor, it undoubtedly strains the neck muscles. Having a shampoo, scalp massage, rinse, conditioner, second scalp massage and second rinse can take over five minutes. State of the art salon sinks often have an integral groove suggesting where a customer can lay her neck, but this groove is rigid and does not prevent overextension. What is supposed to be a relaxing and pampering experience becomes stressful and painful, particularly for salon customers of a certain age. The prior art has attempted to overcome this problem by adding padding to the salon sink edge. However, these are not any more comfortable and still do not provide the cushioning and support this part of the body requires. Other prior art supports which attach directly to salon chairs tend to slip, require cumbersome fastening devices that tangle and do not allow the user's head and hair to extend over the edge of the sink.

This industry needs a means for more comfortably supporting the head and neck of a person reclining backward in a chair toward a salon sink. It would properly support the cervical spine and neck muscles while in the reclining position. It would also allow the user's head and hair to extend over the edge of the sink and receive water. The support is coupled to the back of a wide variety of chairs without the need for external fasteners, and then manually removed for cleaning or for storage.

BRIEF SUMMARY OF THE INVENTION

In accordance with one embodiment of the invention, I provide an improved head and neck support which couples to an upper back edge of a chair, preferably a reclining salon chair. The improved support comprises a rigid inner clamping means, an inner filling of compressible material, all enclosed by an outer covering with a sufficiently high coefficient of friction to grip the front and the back of an upper back of the chair under the weight of a user's head as the user reclines in the chair. The composite filled support further has a length, a width and a height, the length being defined as the longest dimension of the support. The composite filled support further comprises an upper portion, and two legs depending therefrom into a lower portion, the space between the legs defining a lengthwise groove parallel to the length of the support, into which an upper back edge of a reclining salon chair may be wedged by friction fit.

The upper portion of the composite support further comprises a front, neck supporting, portion convexly curved to support the natural cervical spine, and a back portion which in a preferred embodiment is substantially identical to the front portion. However, a rear upper portion can also assume any number of practical or ornamental shapes. The rear upper portion can be the same curvature as the front in mirror image. It may be flat or any other desired shape.

The lower portion of the composite support further comprises three means for coupling to a reclining salon chair. The primary coupling means is internal and comprises a clamp. The clamp comprises a piece of thermoplastic, metal or other rigid memory material having a generally horseshoe-shaped cross section and a length. It functions similarly to a ladies' headband holding hair against the head, only this clamp is longitudinal. The clamp is inserted into and is completely enclosed by the outer covering material. On an outer surface, the clamp is covered by a thickness of inner filling. An inner surface of the clamp directly contacts the covering material and is not covered by any thickness of inner filling. The clamp is completely embedded in the covering and never directly touches either the chair or the user. The user resting on the composite support only feels the inner filling and outer covering.

In a preferred embodiment, the distance between a front leg and a back leg of the horseshoe-shaped clamp is smaller than a width of the upper back of the reclining salon chair. When the composite support is inserted over the upper back of the reclining salon chair, the front and back leg separate slightly, then retract to press against the upper back of the reclining salon chair, thereby clamping it in place along the length of the composite support.

The second, further, coupling means arises from the choice of inner filling. The inner filling comprises a material which resists compression, yet springs back to its original shape, such as a memory foam. Not only does the inner filling cushion the user against the rigid clamp and hard chair, it also pushes against both a front face and a back face of the upper edge of a reclining salon chair, thereby further securely gripping the chair without any external fasteners.

The third coupling means is external. The outer covering comprises a material with a high coefficient of friction, such as natural leather, faux leather or vinyl. Other like materials can be used as the outer covering. The stickiness of the outer covering material further still assists the composite support grip the chair under the weight of a user's head as the user reclines in the chair.

From a front or rear perspective, a topmost edge of the upper portion can assume any silhouette. In a preferred embodiment shown in the drawings, the top most edge of the upper portion is concave. However, it can also be convex, straight or ornamental.

The outer covering may be fashioned from a single sheet of the chosen material, or seamed together from a plurality of sheets of the chosen material. The number and position of the seams is not important, as long as the outer covering securely and completely encloses the inner filling and the clamping means and firmly and completely contacts the front and back surfaces of the upper back of the reclining chair. The material selected for the outer covering should be sufficiently flexible for shaping into the desired configuration, have a sufficiently high coefficient of friction to grip the front and the back of an upper back of the chair under the weight of a user's head, as the user reclines in the chair, and also be impervious to liquid, for durability and ease of cleaning.

REFERENCE NUMBERS

Figure 1:
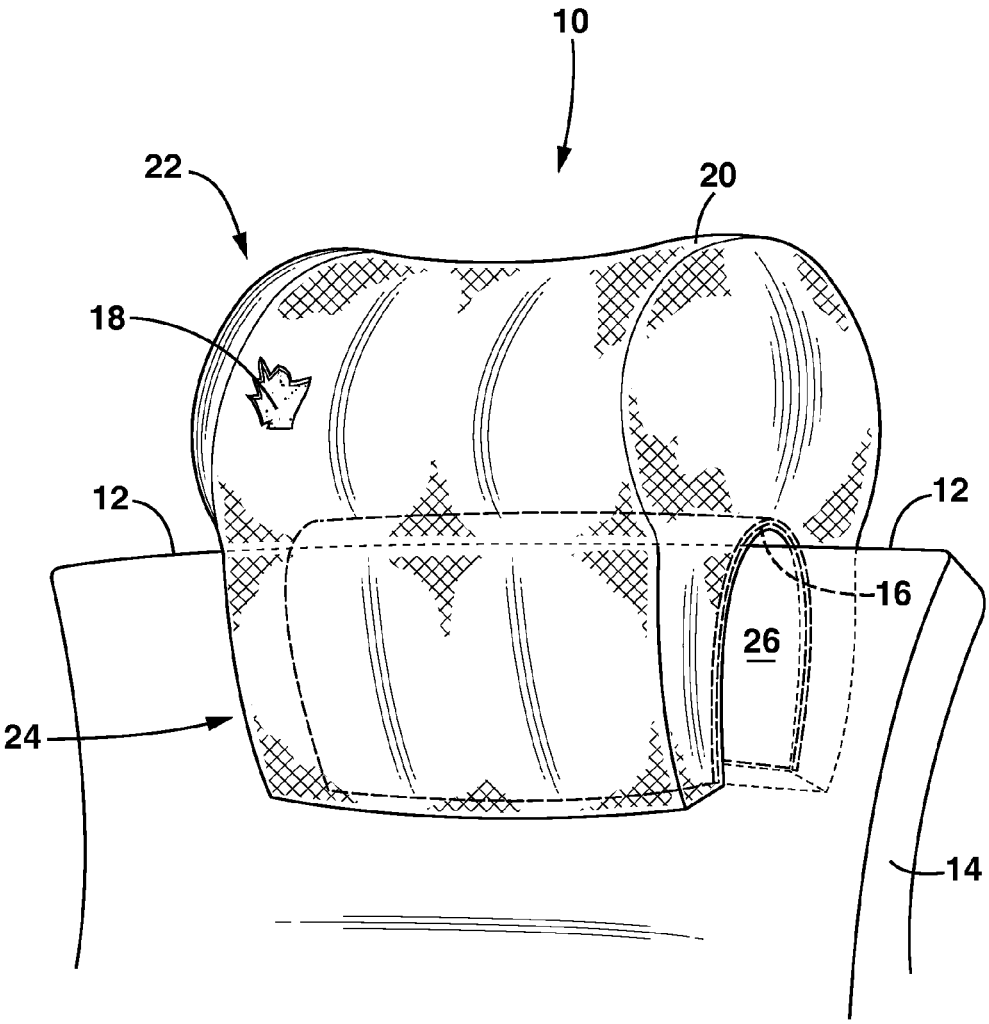
FIG. 1 is a perspective view of the removable head and neck support for reclining salon chair.

10 removable head and neck support for reclining chair
12 upper back edge
14 reclining salon chair
16 innermost clamping means, showing two prongs
18 inner filling
20 outer covering
22 upper portion
24 lower portion
26 groove

DETAILED DESCRIPTION OF THE INVENTION

Referring to FIG. 1, there is a removable neck support 10 coupled to an upper back edge 12 of a chair 14. Preferably the chair is a reclining salon chair. Note the lower portion 24 and the upper portion 22 of the support 10. The lower portion further bears a groove 26 which receives the upper back edge 12 of the chair 14. The support 10 comprises three layers, shown from outside to inside. There is an outer covering 20, an inner filling 18 and, in the lower portion, an innermost clamping means 16.

The support 10 has a length, a width and a height. The length of the support 10 can vary, but is most preferably shorter than the width of the upper back edge 12 of the chair to which it is coupled. This optimizes the surface area of the support 10 which couples to the chair 14.

In a preferred embodiment, the total height of the support 10 is about 23 cm. The upper portion 22 is about 11 cm tall and the lower portion 24 is about 13 cm tall. The specific dimensions of the support can be varied to optimize the amount of surface area available to support the user's head and also to grip the upper back edge 12 of the chair.

The innermost clamping means 16 is preferably molded of or bent from a durable and rigid memory material, in cross section the shape of a horseshoe, but running the length of the lower, chair gripping portion of the support 10. In a preferred embodiment, the rigid memory material is thermoplastic, but it may also be metal. The clamping means 16 does not extend into the upper portion 22 of the support 10. The clamping means is completely enclosed in the outer covering 20, and on an outer surface by a layer of compressible memory foam 18. The thickness of the inner filling 18 surrounding the inner clamping means in the chair gripping portion 24 can vary and can be determined by those skilled in the art.

In the same preferred embodiment, the length of the lower portion 24 of the support 10 is about 26 cm. The length of the upper portion 22 of the support is about 28 cm. The rigid inner clamping means is between 21 and 25 cm long, although again these dimensions can be varied by those skilled in the art to optimize the surface area of the support contacting the desired chair.

Figure 2:
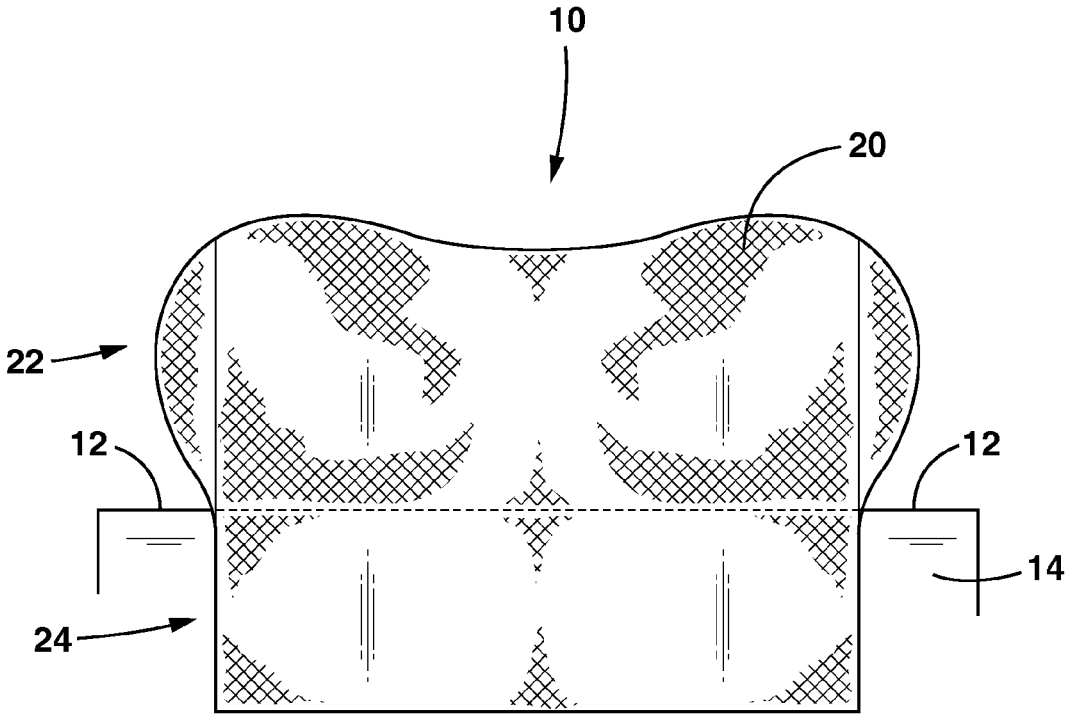
FIG. 2 is a front view of FIG. 1.

FIG. 2 shows a front view of FIG. 1. In a preferred embodiment, the upper portion dips down concavely in the middle of its length. However, the upper portion may also curve upward convexly, have an ornamental curve or no curve whatsoever.

Figure 3:
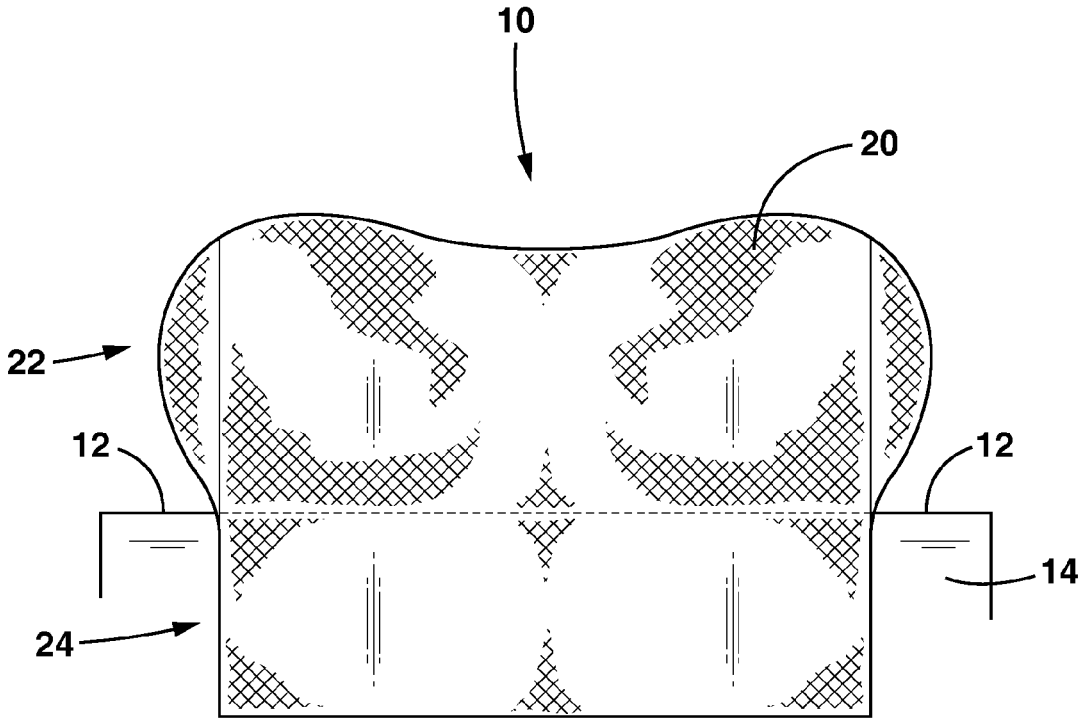
FIG. 3 is a back view of FIG. 1.

FIG. 3 shows a back view of FIG. 1. In a preferred embodiment, the back view is substantially the same as the front.

Figure 4:
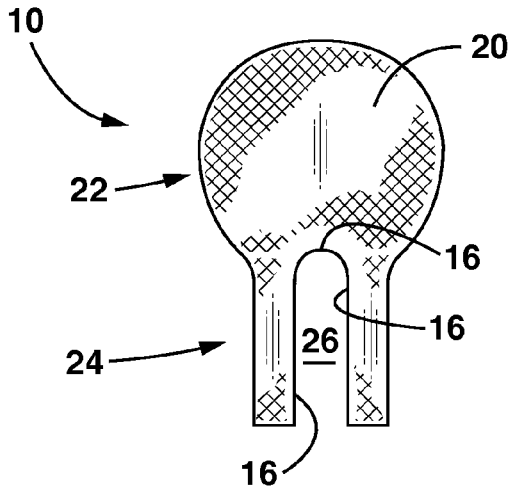
FIG. 4 is a right side view of FIG. 1, with salon chair removed, left side being substantially opposite.

FIG. 4 shows a right side view of FIG. 1, with the salon chair removed. In a preferred embodiment, the upper portion 22 is about 13 cm wide at its widest portion. The groove 26 separates the lower portion 24 into two distinct legs, oriented equidistant from a center axis of symmetry. The lower portion 24 is about 4 cm from the left outermost edge to the right outermost edge. The space forming the groove 26 is preferably 0.5-3.5 cm across, although this also can be varied by those skilled in the art to optimally grip and retain the chair. The inner filling fills the entire support 10, including the lower portion 24.

Figure 5:
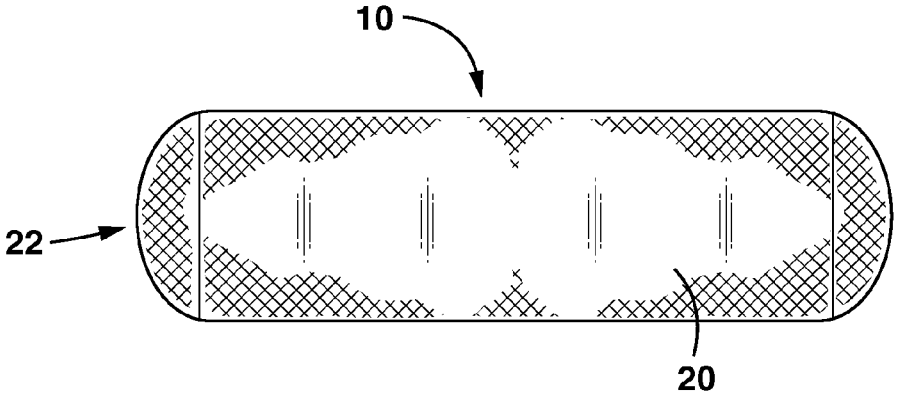
FIG. 5 is a top view of FIG. 1, with salon chair removed.

FIG. 5 shows a top view of the support 10. As the upper portion 22 of the chair is longer than the lower portion 24 and the groove 26, those lower portions are not shown. Note the convex curvature of the support at the right and left edges. This is to optimize the amount of inner filling material available to fill the outer covering.

Figure 6:
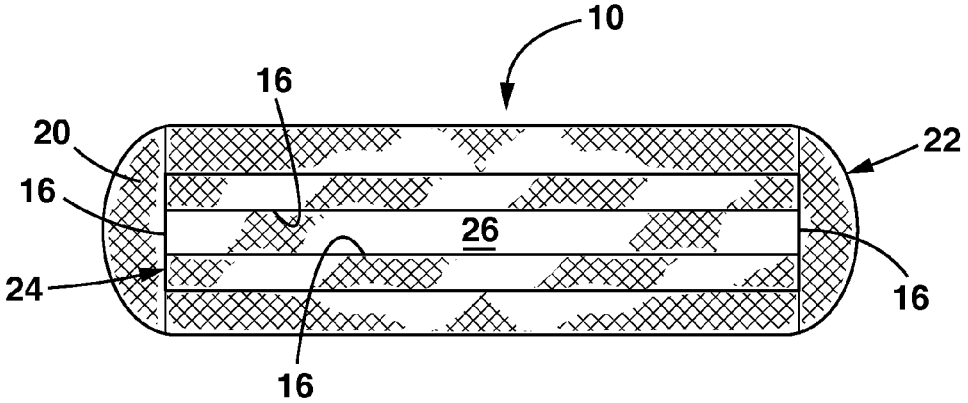
FIG. 6 is a bottom view of FIG. 1, with salon chair removed.

FIG. 6 shows a bottom view of the support 10. Note the upper portion 22 extending beyond the length of the lower portion 24 and the groove 26. Note also the groove 26 centered both longitudinally and vertically.

Figure 7:
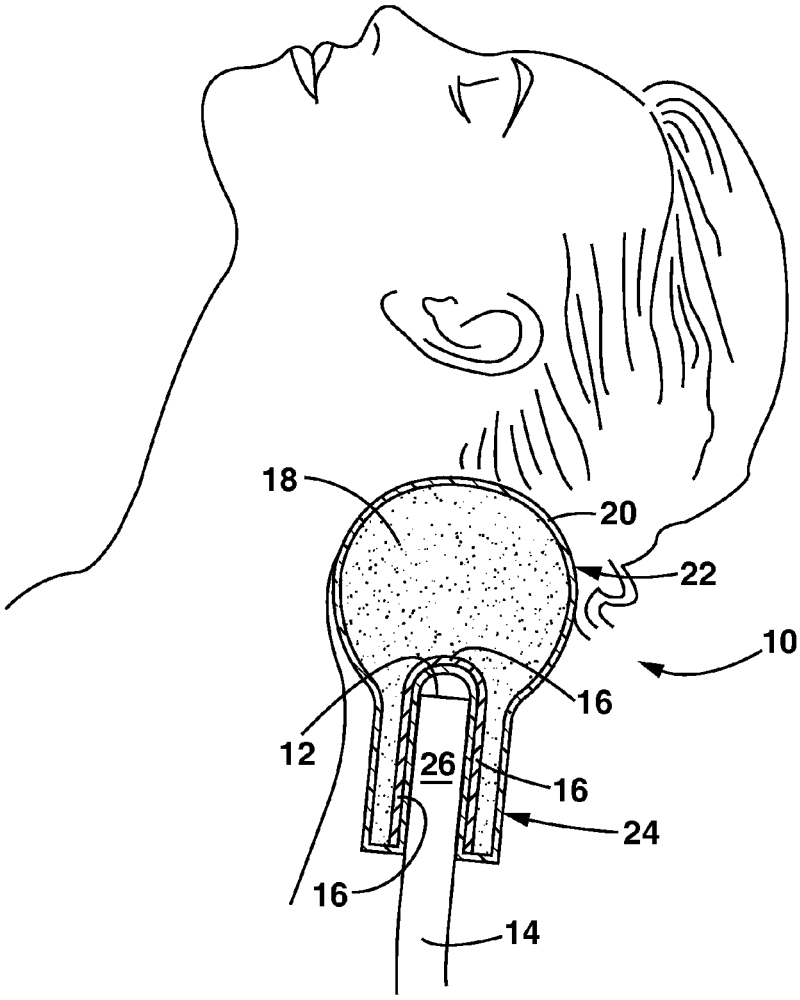
FIG. 7 is a center sectional view of the invention in use.

In FIG. 7, a user rests her head on the upper portion of the support 10 wedged onto a reclining salon chair. The inner filling 18 formed in a convex shape supports her head on the chair as the chair is tilted rearward toward a water source, without overextending her spine. The upper back edge 12 of the reclining salon chair is wedged into the groove. In practice, the inner filling 18 in both legs of the lower portion, is compressed as the support is being wedged onto the upper back edge of the chair. One leg of the lower portion contacts the front of the upper back edge of the chair; the other leg contacts the back of the upper back edge of the chair. Releasing the support under the weight of the user's head allows the foam to expand toward both the front and the back of the upper back edge 12. This expansion holds the support 10 against the chair. The outer covering 20, by virtue of its high coefficient of friction, further grips the support onto the upper back edge 12 of the chair. The combination of the compressed foam and friction of the outer covering provides sufficient force to retain the support 10 on the chair while a user is resting upon it, eliminating the need for any external fasteners. The support is not permanently attached to the chair; it can be pulled off with ordinary effort, for cleaning or storage.

I claim:

1. A head and neck support configured to be removably wedged about an upper back edge of a reclining chair with a back, the upper back edge of the chair having a front face and a back face, the support comprising a/an:

a. Bulbous upper portion configured to support a posterior side of a user's head and neck, this bulbous upper portion having a length and a width and extending upwardly and outwardly;

b. Distinct lower portion, this lower portion comprising:

i. two substantially straight legs depending perpendicularly and downwardly from the bulbous upper portion, the legs having a front wall defining a downward length and a sideways width and end walls defining a thickness, the width of each leg running parallel to the other leg and parallel to the length of the bulbous portion wherein the bulbous upper portion extends upwardly and outwardly from the front and end walls of each leg; and ii. a longitudinal groove between the two legs configured to grip an upper back edge of a chair;

c. Inner filling material having compression memory;

d. Outer covering material shaped to form a three-dimensional support enclosing the inner filling material, the outer covering material having a sufficiently high coefficient of friction to grip and retain the front and the back of an upper back of the chair under the weight of a user's head as the user reclines in the chair; and e. Innermost clamping means embedded within both the inner filling material and the outer covering and positioned substantially entirely within the lower portion, the clamping means comprising a front and a rear prong.

2. The head and neck support as in claim 1, wherein each such leg comprises inner filling material and one prong of the innermost clamping means.

3. The head and neck support as in claim 1, wherein the outer covering is selected from the group consisting of genuine leather, artificial leather, vinyl and other materials, wherein such outer covering material also has a sufficiently high coefficient of friction to grip and retain the front and the back of an upper back of the chair under the weight of a user's head as the user reclines in the chair, and wherein such outer material is also impervious to water.

4. The head and neck support as in claim 1, wherein the inner filling material is selected from the group consisting of viscoelastic polyurethane foam, memory foam, and other materials configured to be compressed by and expand against a force.

5. The head and neck support as in claim 1, wherein the innermost clamping means is made of a rigid shape-memory material selected from the group consisting of thermoplastic and metal.

6. A method of supporting a user's head while seated in a chair with a back, comprising: wedging an upper back edge of the chair into a groove of a support, the support comprising a/an:

a. Bulbous upper portion configured to support a posterior side of a user's head and neck, this bulbous upper portion having a length and a width and extending upwardly and outwardly;

b. Distinct lower portion, this lower portion comprising:

i. two substantially straight legs depending perpendicularly and downwardly from the bulbous upper portion, the legs having a front wall defining a downward length and a sideways width and end walls defining a thickness, the width of each leg running parallel to the other leg and parallel to the length of the bulbous portion wherein the bulbous upper portion extends upwardly and outwardly from the front and end walls of each leg; and ii. a longitudinal groove between the two legs configured to grip an upper back edge of a chair;

c. Inner filling material having compression memory;

d. Outer covering material shaped to form a three-dimensional support enclosing the inner filling material, the outer covering material having a sufficiently high coefficient of friction to grip and retain the front and the back of an upper back of the chair under the weight of a user's head as the user reclines in the chair; and e. Innermost clamping means embedded within both the inner filling material and the outer covering and positioned substantially entirely within the lower portion, the clamping means comprising a front and a rear prong.

7. The method of claim 6, wherein the wedging step is accomplished by the inner filling material simultaneously pressing against a front and a back of the upper back edge of the chair as the filling expands.

8. The method of claim 7, wherein the wedging step is further accomplished by the outer covering material adhering by friction to the front and the back of the upper back edge of the chair.

9. The method of claim 8, wherein the wedging step is further still accomplished by the front and rear prongs of the innermost clamping means simultaneously pressing against the front and the back of the upper back edge of the chair.

10. The method of claim 6, wherein the outer covering is selected from the group consisting of genuine leather, artificial leather, vinyl and other materials, wherein such outer covering material also has a sufficiently high coefficient of friction to grip and retain the front and the back of an upper back of the chair under the weight of a user's head as the user reclines in the chair, and wherein such outer material is also impervious to water.

11. The method of claim 6, wherein the inner filling material is selected from the group consisting of viscoelastic polyurethane foam, memory foam, and other materials configured to be compressed by and expand against a force.

12. The method of claim 6, wherein the innermost clamping means is made of a rigid shape-memory material selected from the group consisting of thermoplastic and metal.

13. A method of coupling a head and neck support to a chair, comprising: wedging an upper back edge of the chair into a groove of a support, the support comprising a/an:

a. Bulbous upper portion configured to support a posterior side of a user's head and neck, this bulbous upper portion having a length and a width and extending upwardly and outwardly;

b. Distinct lower portion, this lower portion comprising:

i. two substantially straight legs depending perpendicularly and downwardly from the bulbous upper portion, the legs having a front wall defining a downward length and a sideways width and end walls defining a thickness, the width of each leg running parallel to the other leg and parallel to the length of the bulbous portion wherein the bulbous upper portion extends upwardly and outwardly from the front and end walls of each leg; and ii. a longitudinal groove between the two legs configured to grip an upper back edge of a chair;

c. Inner filling material having compression memory;

d. Outer covering material shaped to form a three-dimensional support enclosing the inner filling material, the outer covering material having a sufficiently high coefficient of friction to grip and retain the front and the back of an upper back of the chair under the weight of a user's head as the user reclines in the chair; and e. Innermost clamping means embedded within both the inner filling material and the outer covering and positioned substantially entirely within the lower portion, the clamping means comprising a front and a rear prong.

14. The method of claim 13, wherein the wedging step is accomplished by the inner filling material simultaneously pressing against a front and a back of the upper back edge of the chair as the filling expands.

15. The method of claim 14, wherein the wedging step is further accomplished by the outer covering material adhering by friction to the front and the back of the upper back edge of the chair.

16. The method of claim 15, wherein the wedging step is further still accomplished by the innermost clamping means simultaneously pressing against the front and the back of the upper back edge of the chair.

17. The method of claim 13, wherein the outer covering is selected from the group consisting of genuine leather, artificial leather, vinyl and other materials, wherein such outer covering material also has a sufficiently high coefficient of friction to grip and retain the front and the back of an upper back of the chair under the weight of a user's head as the user reclines in the chair, and wherein such outer material is also impervious to water.

18. The method of claim 13, wherein the inner filling material is selected from the group consisting of viscoelastic polyurethane foam, memory foam, and other materials configured to be compressed by and expand against a force.

19. The method of claim 13, wherein the innermost clamping means is made of a rigid shape-memory material selected from the group consisting of thermoplastic and metal.

20. The method of claim 13, wherein the chair is a reclining chair.

* * * * *